US007018008B2

(12) United States Patent
Tsujimoto

(10) Patent No.: US 7,018,008 B2
(45) Date of Patent: Mar. 28, 2006

(54) DATA PROCESSING APPARATUS, PRINTING SYSTEM, PRINTING METHOD, AND COMPUTER-READABLE CONTROL PROGRAM

(75) Inventor: Takuya Tsujimoto, Ohta-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/659,035

(22) Filed: Sep. 9, 2003

(65) Prior Publication Data

US 2004/0113963 A1 Jun. 17, 2004

(30) Foreign Application Priority Data

Sep. 11, 2002 (JP) ..... 2002-265471

(51) Int. Cl.
*B41J 29/38* (2006.01)

(52) U.S. Cl. ..... 347/16

(58) Field of Classification Search ..... 347/16, 347/19, 105, 104, 5
See application file for complete search history.

(56) References Cited

U.S. PATENT DOCUMENTS 6,386,669 B1 * 5/2002 Scofield et al. ..... 347/14
6,574,002 B1 * 6/2003 Paczewitz ..... 358/1.13

* cited by examiner

*Primary Examiner*—Lamson D. Nguyen
(74) *Attorney, Agent, or Firm*—Canon U.S.A. Inc I.P. Div.

(57) ABSTRACT

In a printing system, feature information of a printing medium set on a printer is acquired from the printer. Information associated with the type of the printing medium is input, and the information associated with the type of the printing medium is registered in connection with the acquired feature information of the printing medium. Thus, an environment is provided which allows a user to make registration of additional information associated with a particular printing medium thereby making it possible to automatically and precisely make setting associated with the particular printing medium.

18 Claims, 9 Drawing Sheets

DATA PROCESSING APPARATUS, PRINTING SYSTEM, PRINTING METHOD, AND COMPUTER-READABLE CONTROL PROGRAM

BACKGROUND OF THE INVENTION

1. Field of the Invention

The present invention relates to a printing system in which the type of a printing medium (printing paper) is automatically detected, and a printing mode suitable for the detected printing medium type is automatically selected.

2. Description of the Related Art

In general, a printing system includes a printer such as a color printer, a host computer for generating print data and controlling the printer, and a communication interface for connecting the printer and the host computer with each other.

Among a large number of types of color printers, an ink-jet printer is used to print on a wide variety of printing media. Some examples of printing medium types are plain paper widely used by copying machines, paper coated with silica or the like to suppress ink bleeding and to achieve good coloring, glossy paper used to print a photographic quality image similar to an image achieved by silver salt photography, a transparency film, transfer paper for iron printing, and a back print film.

When printing on a medium is performed, a user selects a printing medium type in setting of a printer driver so that printing is properly performed depending on the printing medium type.

Recently, a printer having a sensor for automatically detecting a printing medium type has been proposed. Such a sensor is called a medium sensor. In this type of printer, a given printing medium is categorized into one of four or five types as shown in FIG. 8. In the example shown in FIG. 8, a printing medium is illuminated with light, and the type of the printing medium is determined on the basis of reflected light (regular reflected light and diffuse reflected light).

However, the conventional technique has the following problems.

In the case in which ink-jet printers do not have a medium sensor, users have to specify a medium type before starting a printing operation. However, selecting a correct medium type from a large number of medium types is troublesome to users. In some cases, selection is incorrectly performed against the intention of a user. When a user does not have sufficient knowledge about printing media, the user cannot properly set the printing conditions depending on the medium type. In particular, when a printing medium is used which is not included in the list of selectable printing media prepared by default by a manufacturer of a printer, it is required to determine which one of printing medium type in the list is most similar to the printing medium which is going to be used. To make the determination, a user has to do a troublesome job including a test printing which needs a long time and which often results in wasting expensive printing media and ink.

To avoid some of the problems described above, it has been proposed to provide a medium sensor on a printer so that a printing medium type is automatically detected and a printing mode most suitable for a printing medium is automatically determined. However, even such a type of printer has still problems as described below.

Printing medium types that can be detected by such a type of printer having a medium sensor are limited to particular medium types such as those shown in FIG. 8. Although the automatic detection of printing medium types does not generally results in great deviations from the best printing conditions, it is still difficult to precisely set printing conditions to be most suitable for a given printing medium. The difficulty results from variations in characteristics of the sensor, variations in characteristics of the same type of printing medium from one medium to another, and the presence of a very large number of printing medium types which are commercially available and which should be correctly detected by the medium sensor. If it is tried to simply increase the number of printing medium types in the automatic detection, the result is an increase in probability that an incorrect medium type is selected. When a printing medium of a type other than those recommended by a manufacturer of the printer, a most similar medium type is automatically selected, and high precision adjustment is impossible.

SUMMARY OF THE INVENTION

In view of the above, it is an object of the present invention to provide a printing system which provides an environment in which a user is allowed to make registration of additional information associated with a particular printing medium thereby making it possible to automatically and precisely make setting associated with the particular printing medium.

To achieve the above object, the present invention provides a data processing apparatus comprising an acquisition unit for acquiring feature information of a printing medium set on a printing apparatus from the printing apparatus, an input unit for inputting name information associated with a printing medium type, and a registration unit for registering, in a relational manner, the feature information of the printing medium acquired from the acquisition unit and the name information associated with the printing medium input via the input unit, in accordance with a manual registration instruction.

The present invention also provides a data processing apparatus comprising an acquisition unit for acquiring feature information of a printing medium set on a printing apparatus from the printing apparatus, a display unit for displaying information associated with the type of the printing medium, in accordance with the feature information of the printing medium acquired from the acquisition unit, a selection unit for selecting a printing medium type, and a correction unit for making a correction such that the information associated with the printing medium type corresponding to the feature information of the printing medium acquired by the acquisition unit is replaced with the printing medium type selected by the selection unit, in accordance with a manual correction instruction.

The present invention also provides a data processing method comprising the steps of acquiring feature information of a printing medium set on a printing apparatus from the printing apparatus, inputting name information associated with a printing medium type, and registering, in a relational manner, the feature information of the printing medium acquired in the acquisition step and the information associated with the printing medium input in the inputting step, in accordance with a manual registration instruction.

The present invention also provides a data processing method comprising the steps of acquiring feature information of a printing medium set on a printing apparatus from the printing apparatus, displaying information associated with the type of the printing medium, in accordance with the feature information of the printing medium acquired in the acquisition step, selecting a printing medium type, and making a correction such that the information associated with the printing medium type corresponding to the feature information of the printing medium acquired in the acquisition step is replaced with the printing medium type selected in the selection step, in accordance with a manual correction instruction.

The present invention also provides a computer-readable program comprising the steps of acquiring feature information of a printing medium set on a printing apparatus from the printing apparatus, inputting name information associated with a printing medium type, and registering, in a relational manner, the feature information of the printing medium acquired in the acquisition step and the information associated with the printing medium input in the inputting step, in accordance with a manual registration instruction.

The present invention also provides a computer-readable program comprising the steps of acquiring feature information of a printing medium set on a printing apparatus from the printing apparatus, displaying information associated with the type of the printing medium, in accordance with the feature information of the printing medium acquired in the acquisition step, selecting a printing medium type, and making a correction such that the information associated with the printing medium type corresponding to the feature information of the printing medium acquired in the acquisition step is replaced with the printing medium type selected in the selection step, in accordance with a manual correction instruction.

Further objects, features and advantages of the present invention will become apparent from the following description of the preferred embodiments with reference to the attached drawings.

DESCRIPTION OF THE PREFERRED EMBODIMENTS

Embodiments of the present invention are described below with reference to the accompanying drawings.

Construction of Printing System

Figure 1:
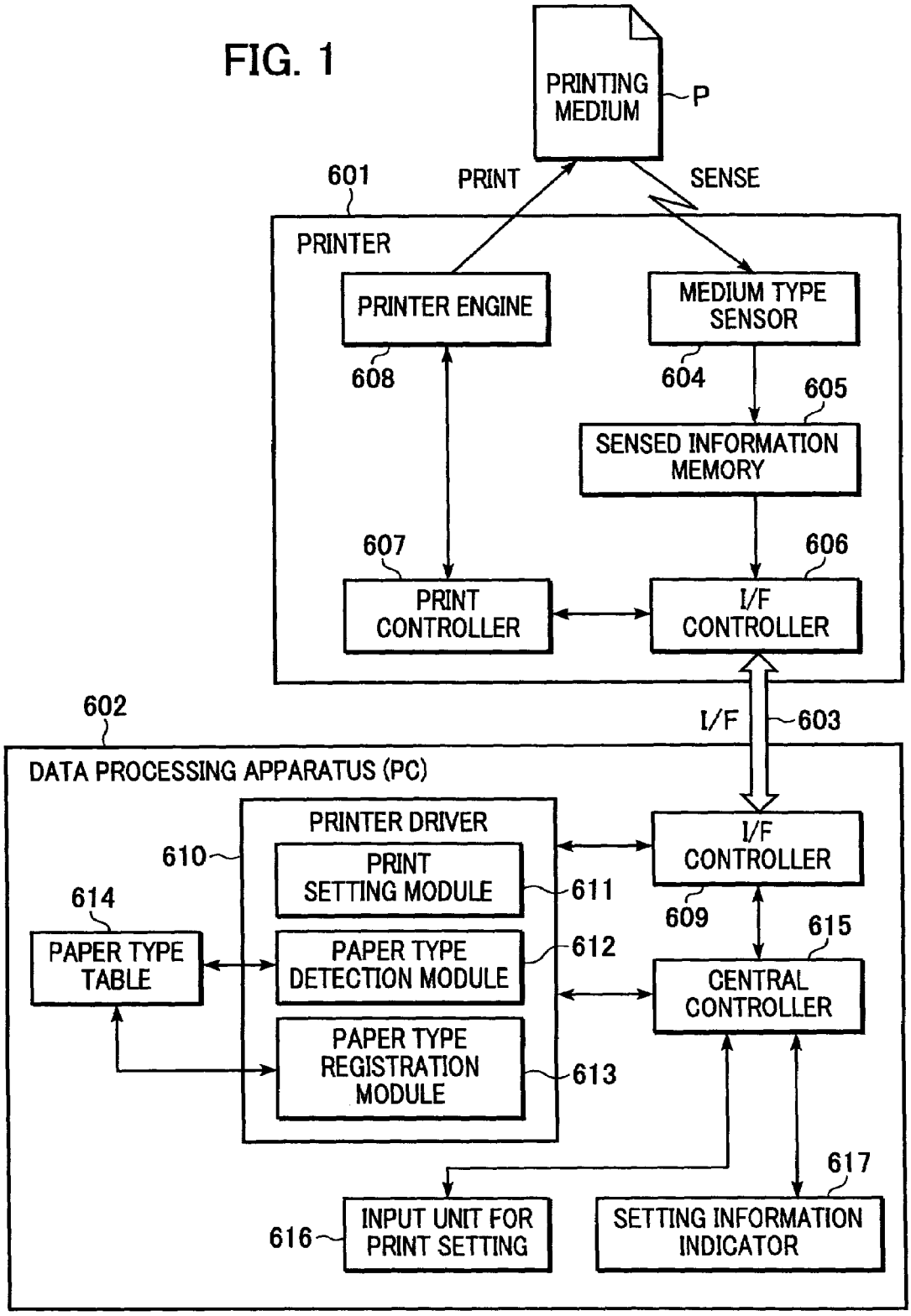
FIG. 1 is a block diagram showing the construction of a printing system according to an embodiment of the present invention.

FIG. 1 is a block diagram showing the construction of a printing system according to an embodiment of the present invention.

In FIG. 1, reference numeral 601 denotes an ink-jet color printer for forming an image in accordance with print data generated by a data processing apparatus 602. In the present embodiment, the printer 601 is assumed to be an ink-jet color printer, although there is no particular restriction on the type of the printer. The printer 601 includes functional blocks 604 to 608.

The data processing apparatus 602 produces print data and controls the printer 601 connected to the data processing apparatus 602. Herein, it is assumed that a personal computer (hereinafter referred to as a PC) is used as the data processing apparatus 602. The PC 602 also serves to receive a print setting command input by a user. The PC 602 includes functional blocks 609 to 617.

A communication interface 603 serves to connect the PC 602 with the color printer 601. Herein, the communication interface 603 is assumed to be a USB (Universal Serial Bus) interface that is one of serial interfaces. Instead of the USB interface, another type of interface, such as an IEEE1394 interface, an Ethernet (trademark) interface, an IrDA interface, an IEEE802.11 interface, a power line, a Centronics interface, or a SCSI interface, may be used if it provides a capability of two-way communication, regardless of whether it is based on wired or wireless communication technology.

In the present embodiment, as described above, the printing system is constructed not by a single apparatus but by two apparatuses, that is, the data processing apparatus 602 and the color printer 601 for forming images, which are connected to each other via a specific two-way interface. In the following description, of various functions of the color printer 601 and those of the PC 602, functions that are not essential to the present embodiment of the invention are not described.

A medium (paper) sensor 604 acquires information needed to detect the type and the size of printing media P. The printing media P are typically stacked on a paper feed tray or cassette of the printer 601. A large number of devices or techniques are available to detect the feature value on the basis of which the printing medium type is determined. Specific examples are a unit for optically detecting a mark formed in advance on a printing medium, a technique in which the printing medium type is determined using a special medium cassette, a technique in which an IC card is embedded in a printing medium, a unit for illuminating a printing medium with particular light and optically detecting reflected light (regular reflected light and diffuse reflected light), a unit for directly or indirectly measuring surface roughness, and a unit for measuring light transmittance. In addition to those described above, it is also known to detect a feature value of a printing medium such as the weight, the thickness, the coefficient of friction, the dielectric constant, the electric resistance, the coefficient of water absorption, and a two-dimensional image of a printing medium, whereby the type of the printing medium is determined on the basis of the detected feature value. The capability of determining the type of a printing medium can be achieved using one of detection units described above or a combination of plurality of detection units. In the present embodiment, there is no particular limitation on the principle or the construction of the medium sensor, as long as it has the capability of detecting the printing medium type at least for printing media that are expected to be used.

A sensed information memory 605 stores information (feature value) of paper sensed by the medium sensor 604. Plural pieces of sensed information may be stored together with history information.

An I/F controller 606 controls an interfacing operation of the printer 601. The interface used in the present embodiment is assumed to be of the USB type, and thus the I/F controller 606 is constructed of a controller designed to control the interfacing operation in a peripheral device. Transmission of information associated with a printing medium and reception of print data and control commands are performed via the I/F controller 606. Via the I/F controller 606, status information indicating an occurrence of an error in the printer or indicating a communication status may be returned to the PC 602 in response to a request issued by the PC 602.

A print controller 607 receives print data transmitted from the PC 602 and controls a printer engine 608 in accordance with the received print data. More specifically, the PC 602 produces print data by performing image processing in accordance with the setting in terms of the type and the size of printing medium or the like, and the PC 602 transmits the resultant print data to the printer 601. In the printer 601, the print controller 607 controls the printer engine in accordance with print control commands included in the print data received from the PC 602. More specifically, the control is performed in accordance with binary print data (or, in some cases, intermediate data before being binarized) and commands for controlling the amount of emission of ink, the path number, the printing direction, and the feeding amount of a printing medium.

The printer engine 608 prints an image on a printing medium P in accordance with the print data supplied from the print controller 607. In the present embodiment, the color printer 601 is assumed to be of the ink-jet type, and thus the image is formed by emitting ink.

An I/F controller 609 controls an interfacing operation of the printer PC 602. The I/F controller 609 includes a controller designed to control the interfacing operation in a USB host device. Some of functions of the USB host may be realized by means of software such as an operating system or a driver.

A printer driver 610 is software executed on the PC 602 to set various printing conditions, produce print data, and control the printer 601. The printer driver 610 includes functional blocks 611 to 614 and other not-shown functional blocks such as a print data generator.

A print setting module 611 serves to set print conditions such as those associated with a printing medium and print quality. The print setting module 611 receives a command or data input and performs setting in accordance with the command or the data. The print setting module 611 also has the capability of displaying the resultant setting or informing the user of the resultant setting.

A medium (paper) type detector 612 detects the type of a printing medium on the basis of the output from the medium sensor 604. In the present embodiment, the type of the printing medium is determined using a reference table.

A medium (paper) type registration module 613 is an essential part in the present invention. The operation of the medium (paper) type registration module 613 is described in the FIG. 2 discussion below.

A medium (paper) type table 614 is used by the medium (paper) type detector 612 to determine the type of the printing medium. The values described in the table can be updated. The table 614 is not simply used by the medium (paper) type detector 612 to determine the type of the printing medium, but is updated such that information associated with printing medium registered in the medium (paper) type registration module 613 is reflected in the table 614.

A central controller 615 controls various functions of the PC 602. The central controller 615 may be realized by a CPU (Central Processing Unit). An input unit 616 is used to set print conditions such that the intention of a user is reflected in the print conditions. The input unit 616 includes various input devices. A setting information indicator 617 informs a user of the currently set print conditions. Informing of the print conditions may be accomplished via a display such as a monitor or via voice notification.

As described above, the printing system according to the present invention includes the color printer 601 having the medium sensor for detecting the feature value of a printing medium, the data processing apparatus 602 such as a PC including the printer driver having the capability of registering information associated with a printing medium, and the two-way communication interface 603 via which the color printer 601 and the data processing apparatus 602 are connected to each other.

General Process of Registering Information Associated with Printing Medium

Figure 2:
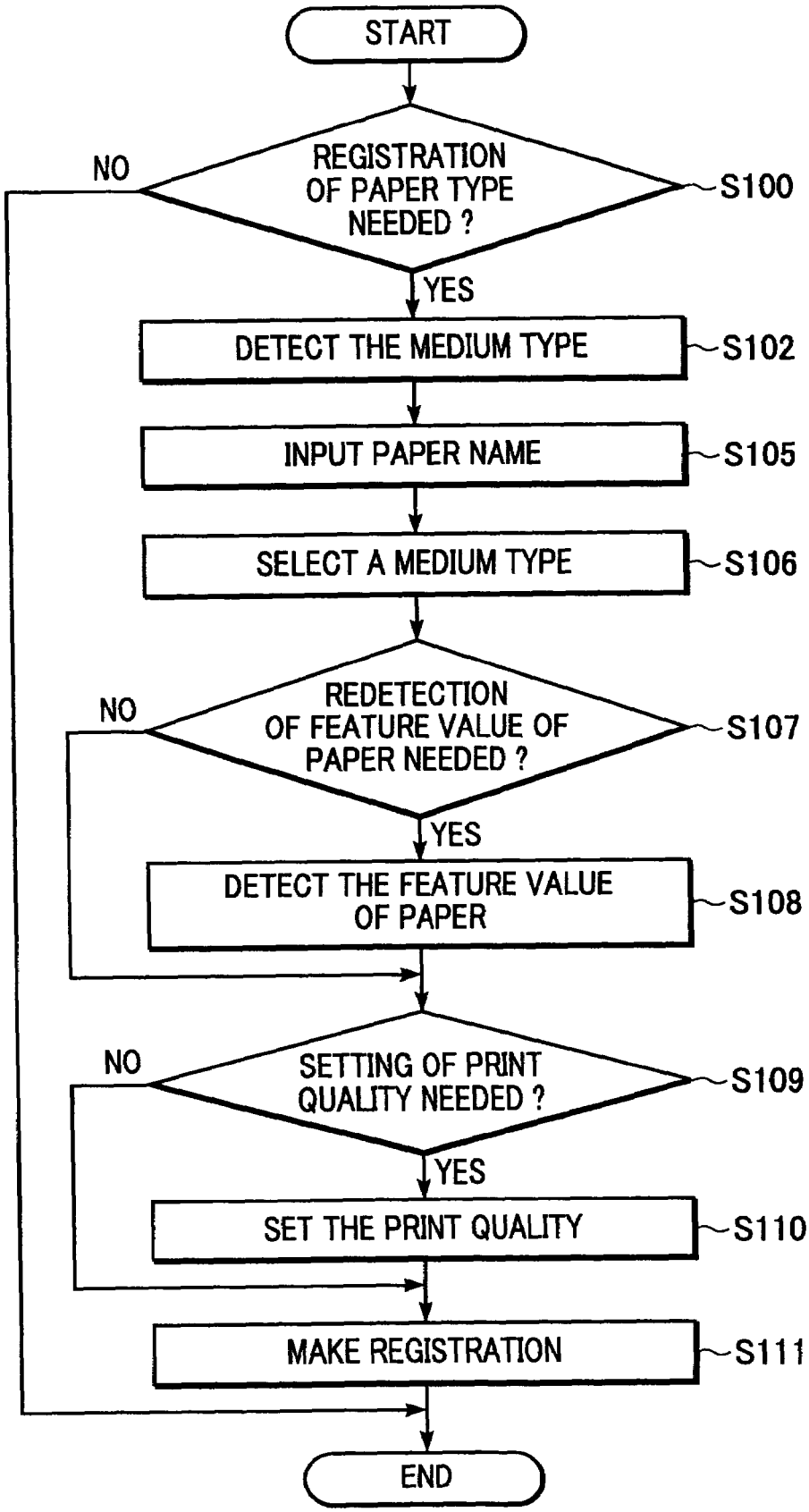
FIG. 2 is a flow chart showing a process of registering information associated with a printing medium according to an embodiment of the present invention.

FIG. 2 is a flow chart showing a process of registering information associated with a printing medium according to the present embodiment of the invention. This process is essential to the present invention. The CPU of the data processing apparatus performs the process shown in this flow chart by executing a program stored in a memory disposed in the data processing apparatus.

Figure 6:
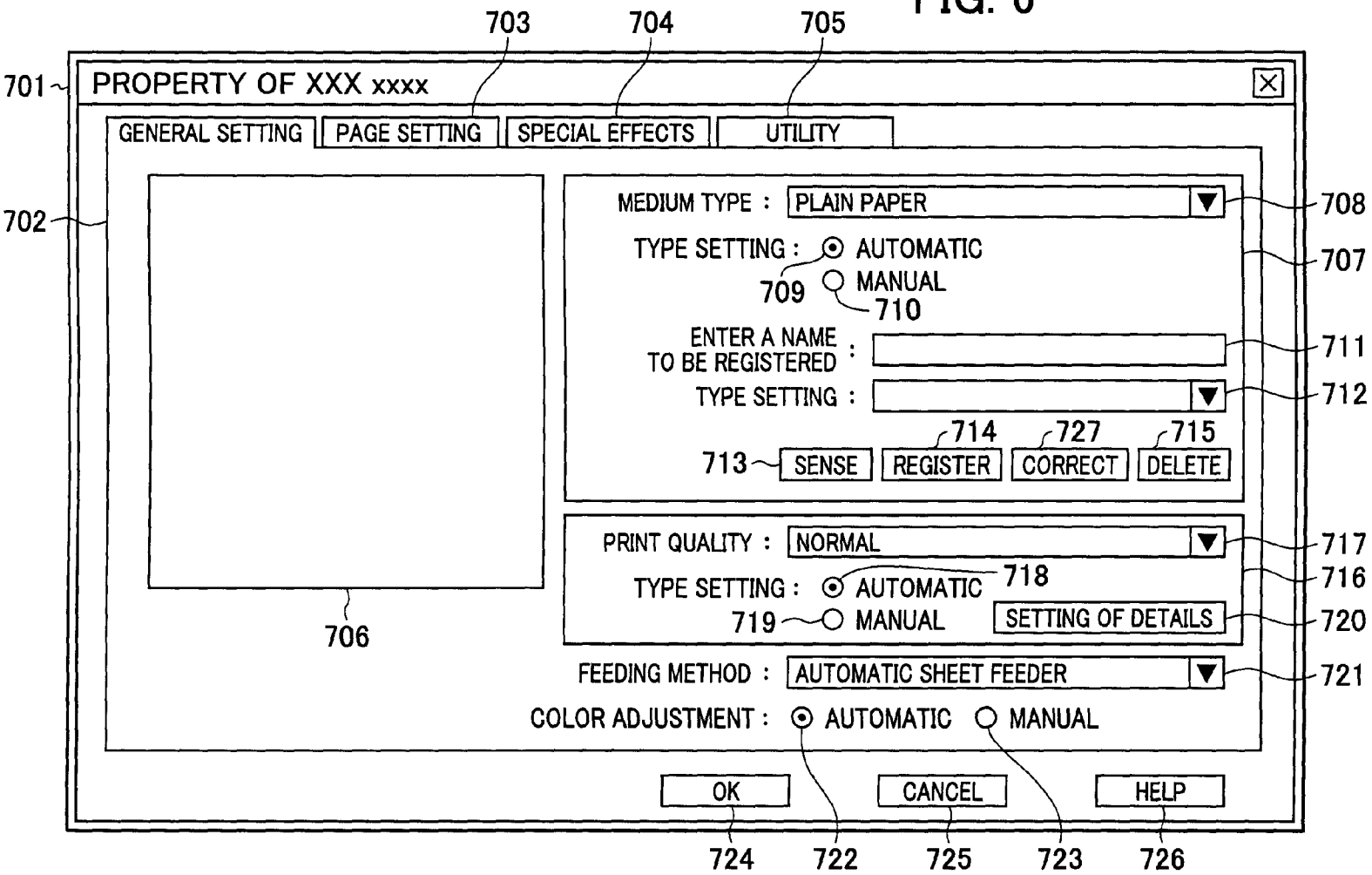
FIG. 6 is a diagram showing an example of a dialog window used to select a printing mode and make setting associated with a printing medium, according to an embodiment of the present invention.

First, a user determines whether a printing medium that is going to be used is of a type already registered in the driver. If it is determined that the printing medium is of a new type which is not yet registered, the user presses a registration button 714 as depicted in FIG. 6. In step S100, it is determined whether the type of the printing medium should be registered, depending on whether the registration button 714 is pressed. If the registration button 714 is pressed, the process proceeds to step S102.

In step S102, in response to a command issued by the PC 602, the printer senses the feature value of a printing medium by using the medium sensor and returns the sensed feature value to the PC 602. On the basis of the received feature value, the PC 602 determines the type of the printing medium. More specifically, the printing medium is categorized into one of five types including plain paper, coated paper, glossy paper, a glossy film, and a transparency film, by using the reference table. Although the reference table is used in this embodiment, the medium type may be determined by numerically calculating a discriminant function including the feature value as a parameter.

Although in the present embodiment, the timing of sensing the medium feature value in the printer and transmitting the information indicating the sensed medium feature value to the PC 602 is after the determination that registration should be performed, the timing of sensing the medium feature value is not limited to that. For example, the medium feature value may be sensed before step S102 and may be stored in the printer.

In step S105, the name of the printing medium to be used is input. The name of the printing medium input herein is incorporated into the list of selectable printing medium types that is used in both the automatic and manual setting modes.

In step S106, a printing medium type is selected from the list. The list includes all printing medium types that are currently selectable in the driver. In the automatic determination mode, as described above, a printing medium type is selected from five types on the basis of the medium feature value sensed by the medium sensor. In the manual determination mode, a printing medium type may be selected from the list including a greater number of alternatives than those in the automatic determination mode. For example, in the manual determination mode, plural types of glossy paper may be included in the list so that the quality of a photographic-like image printed on glossy paper may be selected from a plurality of quality levels.

In step S107, it is determined whether redetection of the feature value of the printing medium to be used is needed before the registration of medium information. Because the feature value of the printing medium has already been detected in step S102, the already detected feature value of the printing medium may be registered in connection with the medium information input and selected by the user without performing redetection of the feature value of the printing medium. However, when it is desirable to obtain additional information to reduce the effects of the sheet-to-sheet variation in feature value, the process proceeds to step S108. If redetection of the feature value is not necessary, step S108 is skipped. The user may select whether step S107 should be performed. After completion of the inputting of a medium name in step S105 and the selection of a medium type in step S106, a dialog may be displayed to prompt the user to select whether redetection of the feature value is performed.

In step S108, the feature value of the printing medium is detected by the medium sensor 604. The obtained feature value is used later in the registration of medium information. The redetection of the feature value of the printing medium may be performed repeatedly to acquire data of a plurality of printing media.

In step S109, it is determined whether the print quality is registered in connection with the printing medium type. The print quality registered herein can be changed later, if desired. The print quality registered herein is used by default when a corresponding printing medium is selected by a user or automatically selected. If it is determined that the print quality should be registered, the process proceeds to step S110. However, if the registration of the print quality is not necessary, step S110 is skipped.

In step S110, the print quality for the printing medium to be used is set. The print quality may be selected, for example, from three print quality levels including a high level in which the printing quality is given a higher priority than the printing speed, a low level in which the printing speed is given a higher priority than the print quality, and a normal level in which an intermediate print quality is achieved at an intermediate printing speed.

In step S111, medium information is newly registered in accordance with setting or detection performed in previous steps. As described above, the registration is performed such that the medium information acquired via the inputting and selection by the user and the feature value of the printing medium detected by the medium sensor 604 are related to each other. The information registered herein can be changed later as required or deleted when it becomes no longer necessary.

Figure 9:
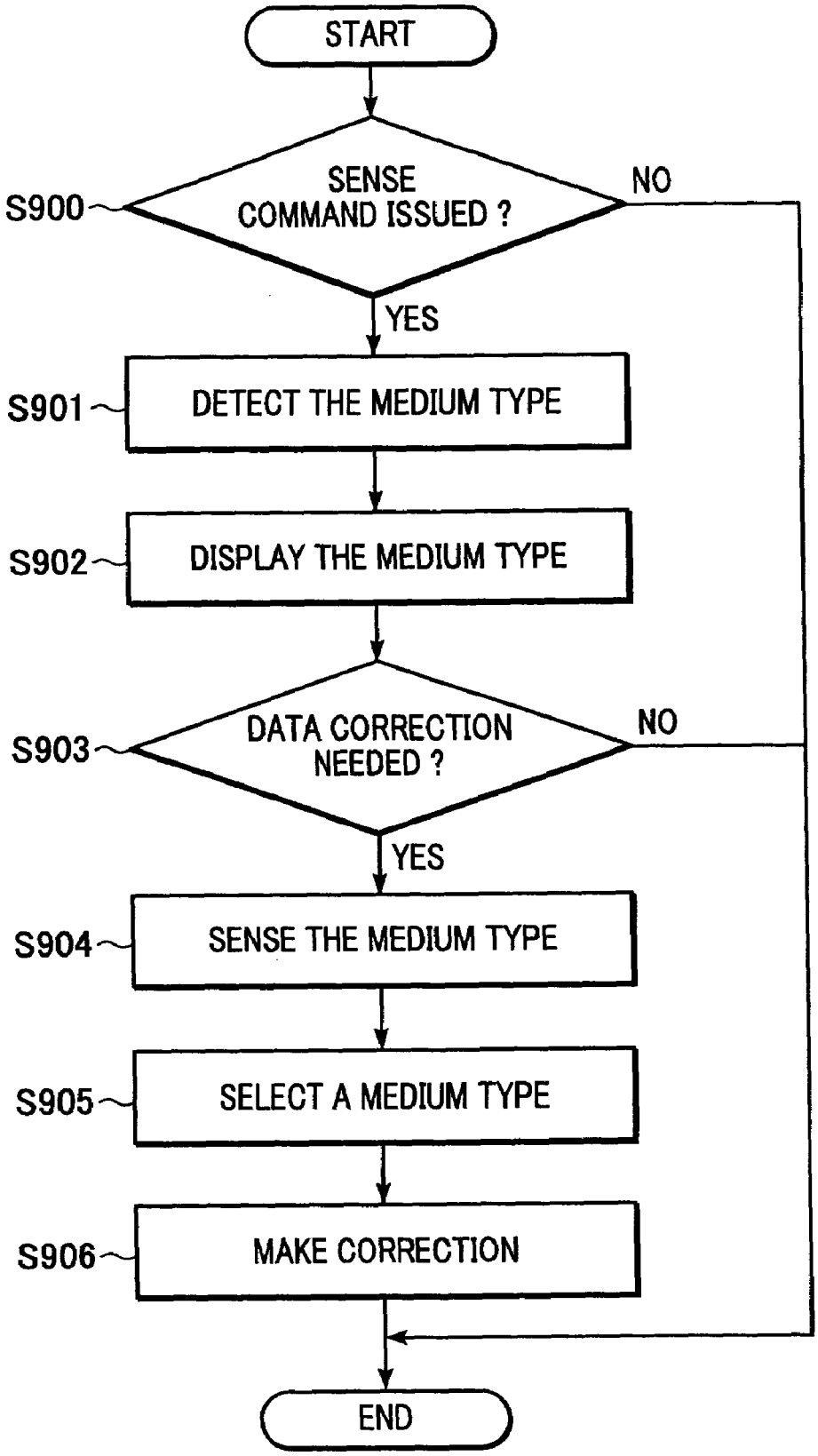
FIG. 9 is a flow chart showing a process of correcting information associated with a printing medium according to an embodiment of the present invention.

Referring to FIG. 9, a process of correcting information associated with a printing medium is described below. This process is performed when a user is not satisfied with print quality for a particular printing medium type, which may be caused by incorrect detection of the feature value performed by the medium sensor. The CPU of the data processing apparatus performs the process shown in this flow chart by executing a program stored in the memory disposed in the data processing apparatus.

In step S900, it is determined whether a sense button 713, as depicted in FIG. 6, is pressed by the user.

If it is determined that the sense button 713 is pressed by the user, the process proceeds to step S901.

In step S901, in response to a command issued by the PC 602, the printer 601 senses the feature value of the printing medium (to be used in the detection of the type of the printing medium) and sends the sensed feature value of the printing medium to the PC 602. On the bases of the received feature value of the printing medium, the type of the printing medium is determined. In the present embodiment, the printing medium is categorized into one of five types including plain paper, coated paper, glossy paper, a glossy film, and a transparency film, by using the reference table. Although the reference table is used in this embodiment, the medium type may be determined by numerically calculating a discriminant function including the feature value as a parameter.

In step S902, the detected type of the printing medium is displayed.

Herein, if the user determines that the type of the printing medium detected in step S901 is different from the actual type of the printing medium set on the printer 601 and that a correction is necessary, the user presses a correction button 727, as depicted in FIG. 6.

In step S903, it is determined whether the user presses the correction button 727. If it is determined that the correction button 727 is pressed by the user and thus that a correction is necessary, the process proceeds to step S904.

In step S904, the feature value of the printing medium is detected using the medium sensor 604 in a similar manner described above with respect to step S108. The detected feature value is used later in the correction of the medium information. The redetection of the feature value of the printing medium may be performed repeatedly to acquire a greater amount of data.

In step S905, a correct printing medium type is selected from the list of medium types so that the medium type will be correctly detected in detection operation performed thereafter.

In step S906, the registration associated with the medium type in connection with the feature value is corrected in accordance with the type of the printing medium selected in step S905 and the feature value detected in step S904. More specifically, the reference table or the discriminant function used in the determination of the printing medium type is modified so that the printing medium type is correctly detected.

As described above, the present embodiment provides an environment that allows a user to freely register the type of a printing medium.

Details of the Process of Determining the Printing Medium Type

Figure 3:
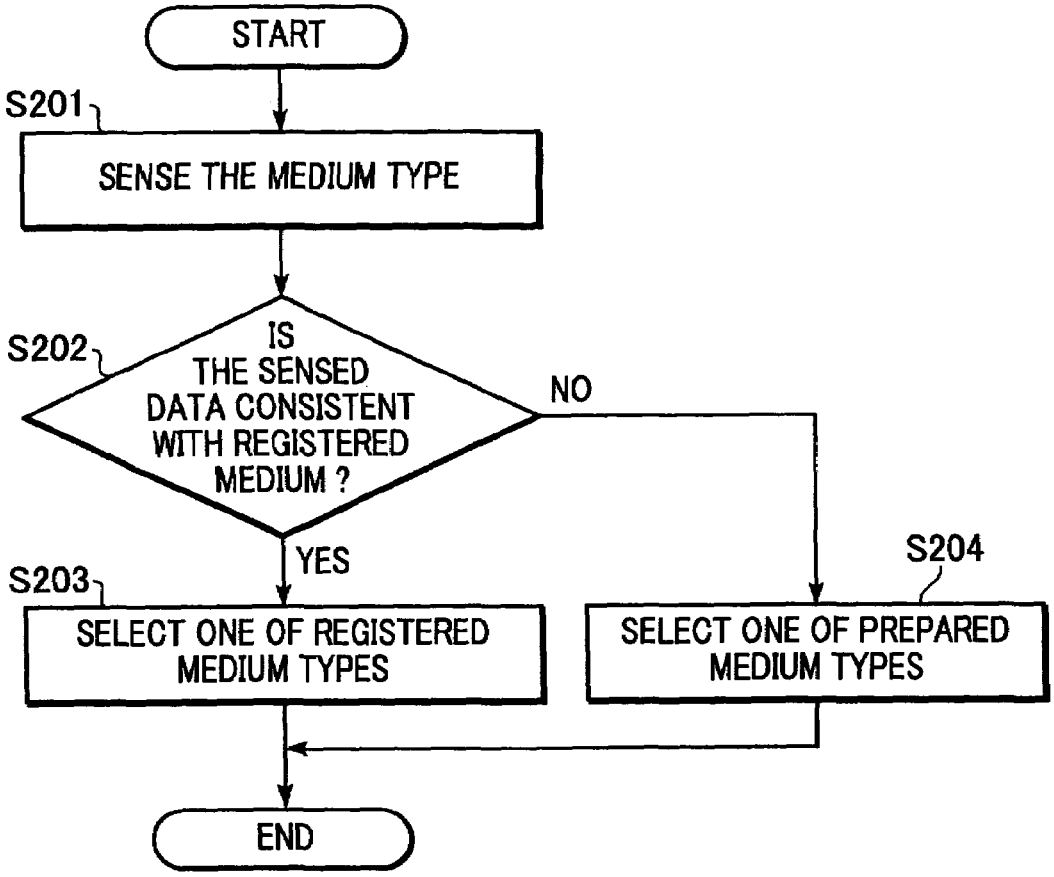
FIG. 3 is a flow chart showing the details of step S101, shown in FIG. 2, of determining the type of a printing medium.

FIG. 3 is a flow chart showing the details of step S102, shown in FIG. 2, of determining the type of the printing medium.

In step S201, the medium sensor 604 senses the type of the printing medium by sensing the feature value of the printing medium to be used.

In step S202, it is determined whether the feature value sensed step S201 falls within a range assigned to a particular printing medium type. This is accomplished by searching medium information registered by the user. The determination is performed by using the reference table or by means of a numerical calculation as described above with respect to FIG. 2. If it is determined that the feature value falls within a range assigned to a particular registered printing medium type, the process proceeds to step S203. However, if the feature value does not match any printing medium type registered by the user, the process proceeds to step S204 to determine the printing medium type in accordance with the default criteria.

Figure 4:
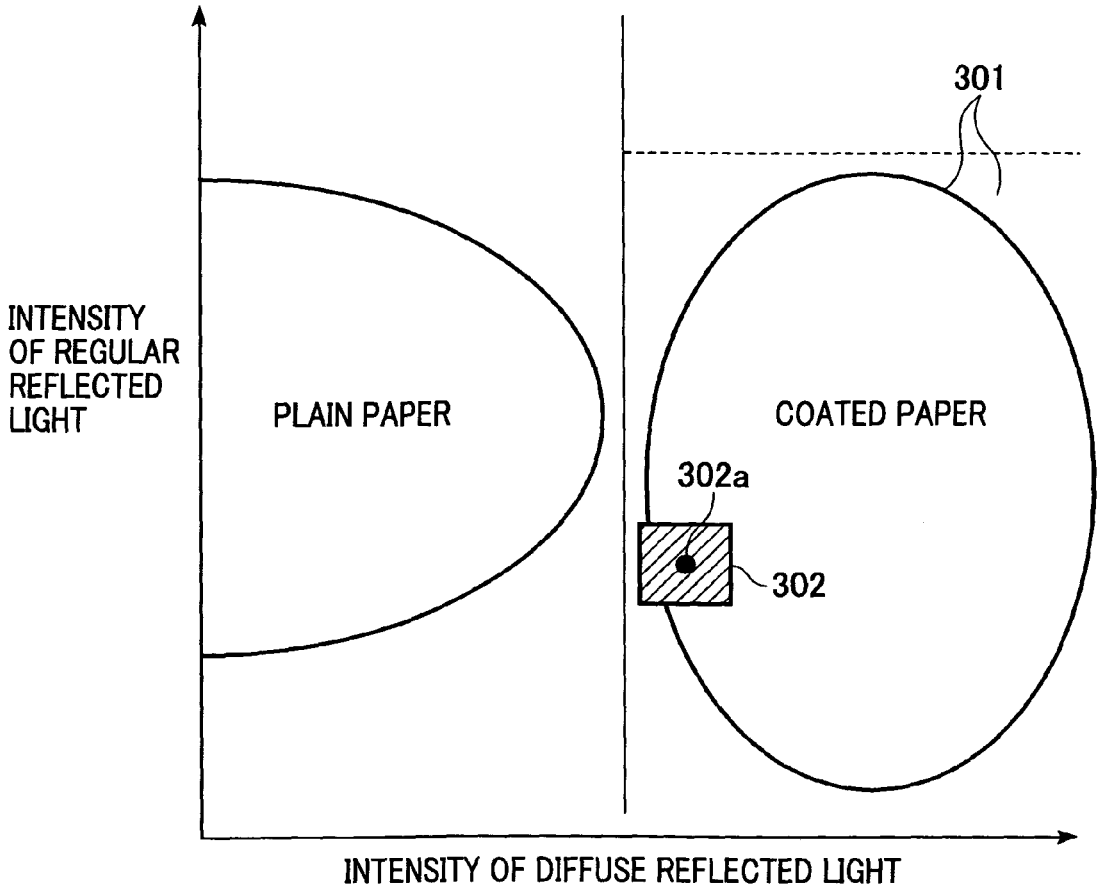
FIG. 4 is a mapping diagram used in determination of a printing medium type.

In step S203, a printing medium type is selected from the registered printing medium types. Higher priority is given to the printing medium types registered by the user in the determination of the printing medium type because the printing medium types registered by the user are expected to be used more frequently than the default printing medium types. The determination of the printing medium type in accordance with the information associated with printing medium registered by the user is further described below with respect to FIG. 4. FIG. 4 is a determination map used by an optical sensor to determine the printing medium type on the basis of the intensity of regular reflected light and the intensity of diffuse reflected light. In FIG. 4, reference numeral 302 denotes an area registered by a user for a printing medium type. A point 302*a* in the area 302 denotes a feature value detected for the printing medium in the registration process. In order to achieve a margin, the point is extended to the rectangular area 302 shaded with diagonal lines, and the rectangular area 302 is assigned to the printing medium type. The area 302 is included in an area 301 assigned, in the default setting, to coated paper. Therefore, in operation in accordance with the default setting, a printing medium detected to be within this area 302 is determined to be coated paper and information is displayed to inform a user of the determination result. However, in the case in which this area 302 has been registered by the user, if a printing medium is detected to be within this area 302, the printing medium is determined as not coated paper, but as a particular printing medium type registered by the user.

In step S204, a printing medium type is selected from default printing medium types or categories prepared by a printer vendor.

In the determination of the printing medium type, as described above, printing medium types registered by the user have higher priority than default printing medium types.

When an area is registered by a user for a particular printing medium type, the resultant area can extend across a boundary of an area assigned by default to a printing medium type. In such a case, the process is performed as described below with reference to FIG. 5.

Figure 5:
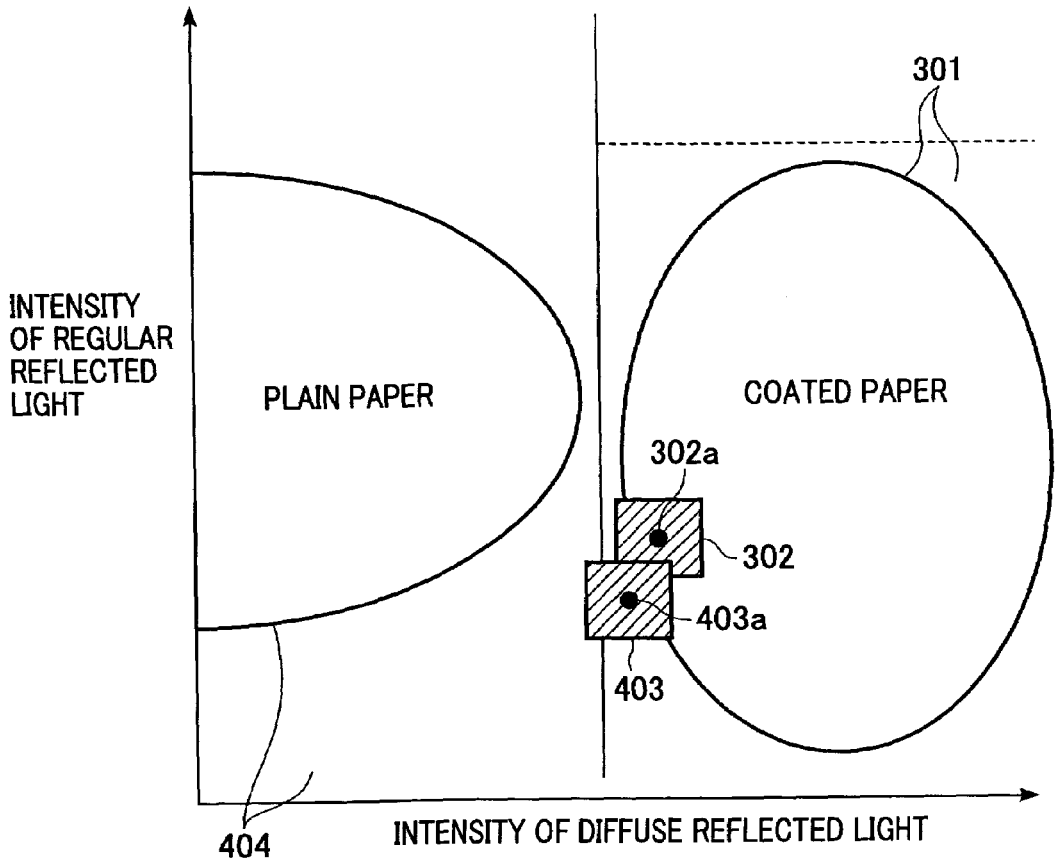
FIG. 5 is a mapping diagram used in determination of a printing medium type.

FIG. 5 is a mapping diagram, similar to that shown in FIG. 4, used in determination of a printing medium type. In FIG. 5, reference numeral 404 denotes an area assigned to plain paper. When an area is registered by a user for a particular printing medium type, the resultant area can extend across a boundary between the area 301 assigned to coated paper and the area 404 assigned to plain paper 404, as is the case with a rectangular area 403 shown in FIG. 5. Also in such a case, the area registered by the user has a higher priority than default areas in the determination of the printing medium type. There is a possibility that areas registered by the user can overlap with each other, as is the case with the rectangular areas 302 and 403. In this case, an area registered most recently is given the highest priority. In the present specific example, the rectangular area 403 has a higher priority than the rectangular area 302. In this case, the printing medium type corresponding to the rectangular area 302 may also be displayed as an alternative, in addition to the printing medium type corresponding to the rectangular area 403. Note that a point 403*a* in FIG. 5 denotes a feature value detected in the registration process.

Example of Dialog Window Used in Setting

FIG. 6 shows an example of a dialog window displayed when setting associated with a printing mode or printing medium is performed according to the present embodiment.

In FIG. 6, reference numeral 701 denotes a dialog window for setting printing conditions. The dialog window 701 includes display areas 702 to 726. In order to display a large number of items in the setting of printing conditions, the dialog window 701 according to the present embodiment includes, as generally employed, a plurality of subwindows that can be opened by clicking corresponding tabs.

Reference numeral 702 denotes a subwindow for general setting, which will be described in detail later.

Reference numeral 703 denotes a tab for opening a page setting subwindow in which current page settings in terms of the printing medium size, the printing direction, the number of copies, the printing layout (when a plurality of pages are printed), and the like are displayed. In this page-setting subwindow, a user can change the setting or can input data.

A special effects tab 704 is used to call a subwindow for selecting a function to make an adjustment on an image or to apply a special effect such as a sepia tone to an image.

Tab 705 is used to call a utility subwindow for selecting a function to make an adjustment or clean a print head on printer 601.

In display area 706, information associated with general settings is displayed in a simple manner using characters and visually appealing graphic images.

In area 707, information associated with a printing medium type is displayed.

Field 708 displays a printing medium type. In an automatic setting mode, the printing medium type is detected on the basis of the sensed feature value of a printing medium and the detected medium type is displayed in field 708. On the other hand, in a manual setting mode, a user selects a printing medium type from a list displayed in field 708. Information associated with a new printing medium type may be registered and the printing medium type may be added to the list.

Check box 709 is used to select the automatic setting mode in which the printing medium type is automatically detected. When check box 709 is selected, a printing medium type detected on the basis of a sensed feature value of a printing medium is displayed in the medium type field 708. Only one of the automatic setting mode and the manual setting mode, which will be described later, can be selected in an alternative fashion.

Check box 710 is used to select the manual setting mode in which a user manually sets a printing medium type. When check box 710 is selected, the user can select an arbitrary printing medium type. Even when the check box 709 for the automatic setting mode is selected, if a printing medium type is selected from the list displayed in the medium type field 708, the mode is switched from the automatic setting mode to the manual setting mode, and check box 710 is switched into a selected state.

Area 711 is used by a user to input a name of a printing medium registered by the user. Preferably, the printing medium name is inputted using a keyboard or by a voice inputting device. However, the present invention is not limited to these two methods, and any method of inputting the printing medium name that would allow practice of the present invention is applicable.

In area 712, a list of profiles is displayed. One of the profiles displayed in area 712 is selected and related to the name input in area 711. A user can select a desired profile for the printing medium in area 712. The user may not only select a profile from the list, but also produce a profile, the method of which is not herein described in further detail.

A button 713 is used to execute sensing of the feature value of a printing medium to be registered.

A button 714 is used to register the name input in input area 711, the profile of the printing medium selected in list area 712, and the feature value of the printing medium which has been detected in advance or which is detected via the sensing operation performed in response to pressing of button 713, in such a manner that they are related to each other. Button 714 is also used when information associated with a printing medium already registered is updated or when information is corrected in accordance with the detected feature value.

A button 715 is used to delete registered information associated with a printing medium.

In area 716, information associated with print quality is displayed.

In field 717, currently selected print quality is displayed. In an automatic setting mode, print quality most suitable for the printing medium type displayed in the medium type field 708 is automatically selected. In a manual setting mode, a list of print quality is displayed so that the user can make a selection from the list.

A check box 718 is used to select the automatic setting mode in which print quality is automatically selected. When this check box 718 is selected, print quality is automatically selected depending on the current printing medium type, and the selected print quality is displayed in the print quality field 717. Only one of the automatic setting mode and the manual setting mode, described below, can be selected in an alternative manner.

A check box 719 is used to select the manual setting mode in which the user manually sets print quality. When check box 719 is selected, the user can select desired print quality. Even when the check box 718 for the automatic setting mode is selected, if print quality is selected from the list displayed in the print quality field 717, the mode is switched from the automatic setting mode to the manual setting mode, and check box 719 is switched into a selected state.

A button 720 is used to set details of print quality. If button 720 is selected, a window for setting the details of print quality appears. In the present embodiment, in the automatic setting mode, the print quality is set to one of three levels: a high level in which the printing quality is given a higher priority than the printing speed; a low level in which the printing speed is given a higher priority than the print quality; and a normal level in which an intermediate print quality is achieved at an intermediate printing speed. In the manual setting mode, the print quality can be set to one of a greater number of levels than in the automatic setting mode. However, all print quality levels are not selectable because the selectable print quality levels depend on the printing medium type.

Reference numeral 721 denotes a list of selectable paper feeding modes. The user can select either a manual feeding mode or an automatic feeding mode.

A check box 722 is used to select an automatic color adjustment mode. When check box 722 is selected, color adjustment is automatically performed. When check box 722 is not selected, the manual color adjustment mode is selected. Only one of check box 722 and a check box for a manual color adjustment mode, which will be described later, can be selected in an alternative manner.

A check box 723 is used to select the manual color adjustment mode in which color adjustment is manually performed. When check box 723 is selected, the user can make color adjustment in a desired manner in a window (not shown) for color adjustment.

Reference numeral 724 denotes an OK button. After the completion of settings, if the user presses the OK button 724, the property window is closed and the print dialog window is again displayed.

Reference numeral 725 denotes a cancel button. When the user determines to employ default settings, if the user presses cancel button 725, the property window and the print dialog window are closed.

Reference numeral 726 denotes a help button. When the user wants to know something about settings associated with the printer driver, if help button 726 is pressed, detailed information is presented.

Although not show in FIG. 6, the dialog window 701 may also include an update button used to update the settings.

As described above, the setting dialog window contains sub windows displayed in a hierarchical fashion so that the user can easily understand and make settings associated with printing conditions.

In the dialog window shown in FIG. 6, if the automatic mode for setting associated with the printing medium and the automatic mode for setting associated with print quality are selected, setting can be performed automatically. In the automatic setting mode, the setting dialog window allows the user to easily know which conditions are set in the printer or the printer driver. Thus, in the printing system of the present embodiment, an image can be printed in a manner desired by the user without encountering a significant deviation from the optimum printing conditions.

As can be understood from the above description, the present embodiment of the invention provides the following advantages.

(1) The embodiment provides an environment which allows a user to arbitrarily make registration of information associated with a particular printing medium in connection with the feature value of that printing medium detected by the medium sensor 604, thereby making it possible to automatically detect the specific printing medium and automatically make setting for that specific printing medium. This makes it unnecessary to make setting in terms of the printing medium type and the print quality each time printing is performed. That is, it becomes unnecessary for a user to perform the very troublesome job of selecting a correct printing medium type from a list including a large number of printing medium types. Any user, even those who do not have knowledge about printing media, can correctly use the printer without encountering problems caused by incorrect setting. The present embodiment is very useful particularly when a printing medium is used which has recently become commercially available or when a printing medium different from those included by default in the list of printing medium types is used. Because incorrect setting is prevented, it becomes unnecessary to perform test printing which needs a long time and can result in wasting expensive ink and printing media.

(2) The feature value of a printing medium can be detected and the type of the printing medium can be determined on the basis of the detected feature value. This makes it possible to automatically make medium type detection for a greater number of medium types than can be detected by the conventional technique.

(3) For medium types additionally registered by a user as well as for existing medium types prepared by default, it is possible to make adjustment to minimize the effects resulting from variations in output of the medium sensor, variations in the characteristics of the printer from one to another, and variations in an environmental conditions. This makes it possible to more precisely determine the printing medium type. In this technique, it is not required to suppress the variation in characteristics of the medium sensor 604 to a very low level, and thus the medium sensor 604 can be produced at low cost.

(4) For printing medium types which are frequently used by a user and which are registered by the user, high priority is given to the printing medium types in the determination and displaying of the printing medium type.

Memory Map of Storage Medium

Figure 7:
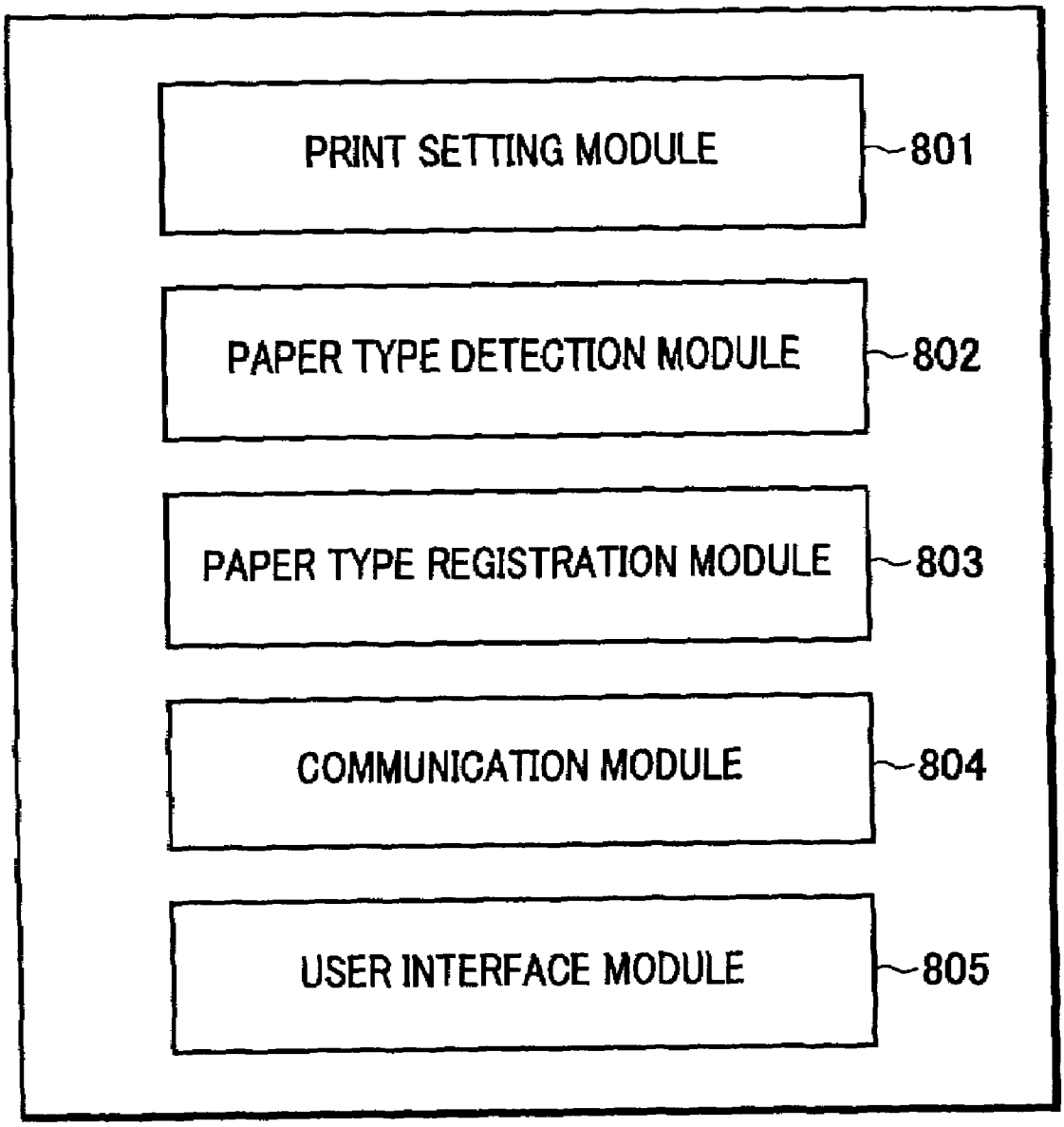
FIG. 7 is a diagram showing a memory map of a storage medium according to an embodiment of the present invention.
Figure 8:
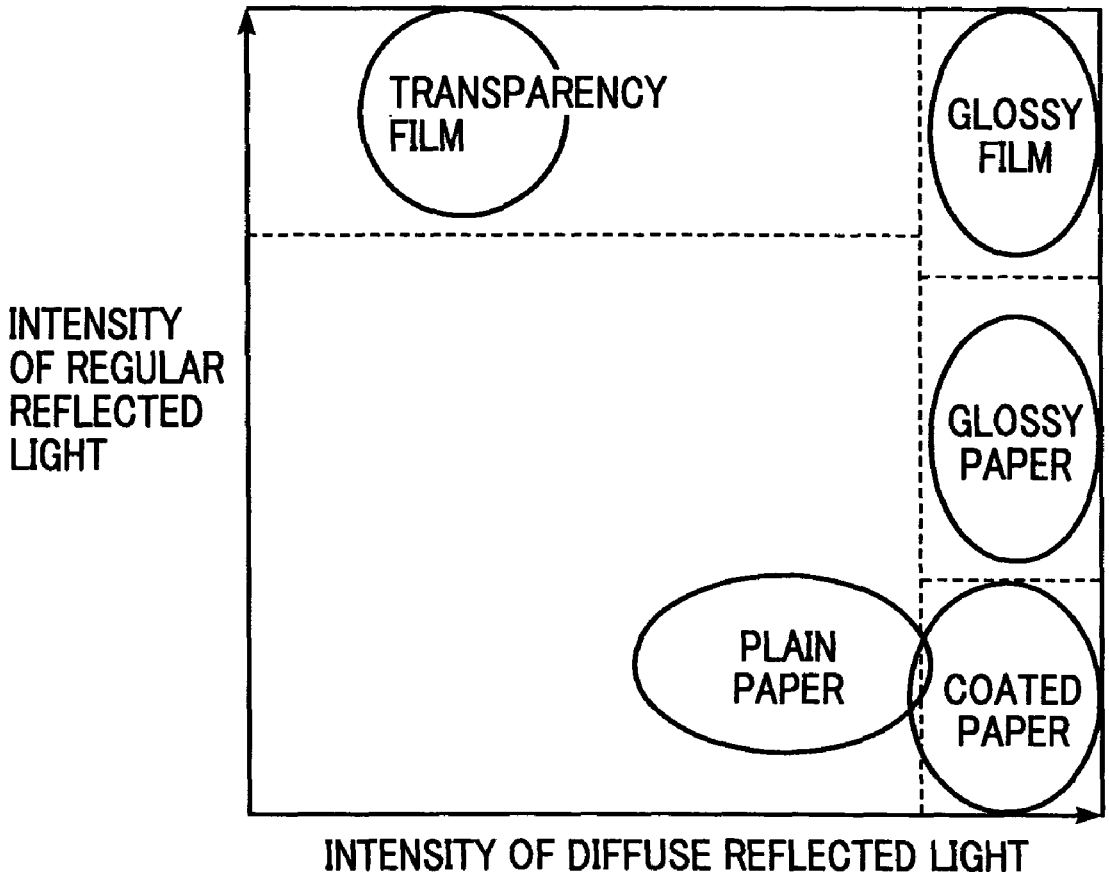
FIG. 8 is a mapping diagram used in determination of a printing medium type according to a conventional technique.

FIG. 7 is a diagram showing a memory map of a storage medium according to an embodiment of the present invention.

The objects of the present invention may also be achieved by supplying a storage medium, on which a software program implementing the functions of any of the embodiments described above is stored, to a system or an apparatus whereby a computer (CPU or MPU) in the system or apparatus reads and executes the program code stored on the storage medium.

In this case, it should be understood that the program code read from the storage medium implements the functions of invention and thus the storage medium storing the program code falls within the scope of present invention.

Specific examples of the storage medium for storing the program code include a FD (floppy (trademark) disk), a hard disk, a CD-ROM disk, a CD-R disk, a CD-RW disk, an optical disk such as a DVD-RAM disk and a DVD+RW disk, a magnetooptical disk such as a MO disk, a magnetic tape, and a non-volatile semiconductor memory card such as a flash memory and a ROM.

Furthermore, the scope of the present invention includes not only such a system in which the functions of any embodiment described above is implemented simply by reading and executing a program code on a computer but also a system in which a part of or the whole of process instructed by the program code is performed using a OS (operating system) on the computer.

Furthermore, the scope of the present invention also includes a system in which a program code is transferred once from a storage medium into a memory provided in a function extension board inserted in a computer or provided in a function extension unit connected to the computer, and then a part of or the whole of process instructed by the program code is performed by a CPU or the like in the function extension board or the function extension unit thereby implementing the functions of any embodiment described above.

When the present invention is applied to a storage medium, the program code corresponding to the flow charts shown in FIGS. 2 and 3 is stored on the storage medium. More specifically, program modules shown in the memory map in FIG. 7 are stored on the storage medium. That is, the program code stored on the storage medium is required to include at least a print setting module 801, a medium type detection module 802, a medium type registration module 803, a communication module 804, and a user interface module 805.

As described above, the program code or the storage medium on which the computer-readable program code is stored can provide a printing system which provides an environment in which a user is allowed to make registration of additional information associated with a particular printing medium thereby making it possible to automatically and precisely make setting associated with the particular printing medium.

Note that the present invention is not limited to the specific embodiments described above, but various modifications are possible. Some examples of modifications are described below.

In the embodiments of the present invention described above, a PC is used as the data processing apparatus that is one of components of the printing system. However, the data processing apparatus does not necessarily have to be a PC. Any data processing apparatus may be used, if it has the capability of automatically setting printing conditions and making registration associated with printing media in a similar manner as described above with reference to the specific embodiments. The printing system may be constructed differently from the embodiments described above such that a greater part, including registration of information associated with printing media specified by a user, of processing is performed by the printer, and a smaller part of the processing is performed by the data processing apparatus. This makes it possible to use, as the data processing apparatus, a simple device such as an electric appliance, an Internet terminal device, or a communication device such as a portable telephone. That is, there is no limitation on each device, as long as the printing system as a whole has the necessary capabilities.

As can be understood from the above description, in addition to PCs, many other devices may also be used as the data processing apparatus. Some specific examples are a digital camera, a set top box, a digital video camera, a digital TV, a BS/CS tuner, a game machine, a portable telephone, and a PDA device.

When printing is performed using a digital device that is not originally designed to be used in connection with a printer, setting of printing conditions can be very troublesome, and there is a possibility that printing is not performed in a desirable manner. Such a problem can be solved by registering information associated with a printing medium thereby making it possible to automatically set printing conditions without requiring the user to do a very troublesome job.

Furthermore, a printing condition such as print quality which is usually determined by a user may be incorporated into printing conditions which are automatically set, thereby achieving a printing system which allows a user to more easily print an image.

It is predicted that a portable telephone or a similar device will have the capability of dealing with content with a large data size. In view of the above, it is very important to establish a mechanism of printing such data. The embodiments of the present invention can also be used to realize a printing system satisfying the above requirement.

As described above with reference to the specific embodiments, the present invention provides a printing system which provides an environment in which a user is allowed to make registration of additional information associated with a particular printing medium thereby making it possible to automatically and precisely make setting associated with the particular printing medium.

This makes it unnecessary to make setting associated with the printing medium type and the print quality each time printing is performed. Any user, even those users who do not have knowledge about printing media, can correctly use the printer without encountering problems caused by incorrect setting. The present invention is very useful particularly when a printing medium is used which has recently become commercially available or when a printing medium different from those included by default in the list of printing medium types is used. Because incorrect setting is prevented, it becomes unnecessary to perform test printing which needs a long time and which can result in wasting expensive ink and printing media.

Furthermore, the present invention makes it possible to automatically make medium type detection for a greater number of medium types than can be detected by the conventional technique.

The capability of correcting already registered information associated with a printing medium on the basis of information supplied from the medium sensor makes it possible to more precisely determine the printing medium type without needing an additional expensive unit.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A data processing apparatus comprising:

an acquisition unit for acquiring feature information of a printing medium set on a printing apparatus from the printing apparatus;

an input unit for inputting name information associated with a printing medium type; and a registration unit for registering, in a relational manner, the feature information of the printing medium acquired from the acquisition unit and the information associated with the printing medium input via the input unit, in accordance with a manual registration instruction.

2. A data processing apparatus according to claim 1, further comprising a selection unit for selecting type information of the printing medium, wherein registration by the registration unit is such that the feature information of the printing medium acquired from by acquisition unit, the name information associated with the printing medium input via the input unit, and the type information of the printing medium selected by the selection unit are related with each other.

3. A data processing apparatus according to claim 1, further comprising:

a detection unit for detecting the printing medium type on the basis of the feature information of the printing medium acquired by the acquisition unit; and a unit for setting a printing condition on the basis of the result of detection performed by the detection unit.

4. A data processing apparatus according to claim 1, wherein the registration unit makes registration such tat the feature information of a printing medium acquired by the acquisition unit, the information associated with the printing medium input via the input unit, and the information associated wit print quality are related with each other.

5. A data processing apparatus comprising:

an acquisition unit for acquiring feature information of a printing medium set on a printing apparatus from the printing apparatus;

a selection unit for selecting type information of the printing medium; and a registration unit for registering, in a relational manner, the feature information of the printing medium acquired by the acquisition unit and the type information selected by the selection unit, in accordance with a manual registration instruction.

6. A data processing apparatus comprising:

an acquisition unit for acquiring, from a printing apparatus, feature information of a printing medium set on the printing apparatus;

a display unit for displaying information associated with the type of the printing medium, in accordance with the feature information of the printing medium acquired by the acquisition unit;

a selection unit for selecting a printing medium type; and a correction unit for making a correction such that the information associated with the printing medium type corresponding to the feature information of the printing medium acquired by the acquisition unit is replaced with the printing medium type selected by the selection unit, in accordance with a manual correction instruction.

7. A data processing method comprising the steps of:

acquiring feature information of a printing medium set on a printing apparatus from the printing apparatus;

inputting name information associated with a printing medium type; and registering, in a relational manner, the feature information of the printing medium acquired in the acquisition step and the name information associated with the printing medium input in the inputting step, in accordance with a manual registration instruction.

8. A data processing method according to claim 7, further comprising the step of selecting type information of the printing medium, wherein registration in the registering step is such that the feature information of the printing medium acquired in the acquisition step, the name information associated with the printing medium input in the inputting step, and the type information of the printing medium selected in the selecting step are related with each other.

9. A data processing method according to claim 7, further comprising the steps of:

detecting the printing medium type on the basis of the feature information of the printing medium acquired in the acquisition step; and setting a printing condition on the basis of the result of detection in the detection step.

10. A data processing method according to claim 7, wherein registration in the registration step is made such that the feature information of a printing medium acquired in the acquisition step, the information associated with the printing medium input in the inputting step, and the information associated with print quality are related with each other.

11. A data processing method comprising the steps of:

acquiring feature information of a printing medium set on a printing apparatus from the printing apparatus;

selecting type information of the printing medium; and registering, in a relational manner, the feature information of the printing medium acquired in the acquisition step and the type information selected in the selection step, in accordance with a manual registration instruction.

12. A data processing method comprising the steps of:

acquiring feature information of a printing medium set on a printing apparatus from the printing apparatus;

displaying information associated with the type of the printing medium, in accordance with the feature information of the printing medium acquired in the acquisition step;

selecting a printing medium type; and making a correction such that the information associated with the printing medium type corresponding to the feature information of the printing medium acquired in the acquisition step is replaced with the printing medium type selected in the selection step, in accordance with a manual correction instruction.

13. A computer-readable program comprising the steps of:

acquiring feature information of a printing medium set on a printing apparatus from the printing apparatus;

inputting name information associated with a printing medium type; and registering, in a relational manner, the feature information of the printing medium acquired in the acquisition step and the name information associated with the printing medium input in the inputting step, in accordance with a manual registration instruction.

14. A computer-readable program according to claim 13, further comprising a selecting step for selecting type information of the printing medium, wherein registration in the registering step is such that the feature information of the printing medium acquired in the acquisitions step, the name information associated with the printing medium input in the inputting step, and the type information selected in the selecting step are related with each other.

15. A computer-readable program according to claim 13, further comprising the steps of:

detecting the printing medium type on the basis of the feature information of the printing medium acquired in the acquisition step; and setting a printing condition on the basis of the result of detection in the detection step.

16. A computer-readable program according to claim 13, wherein registration in the registration step is made such that the feature information of a printing medium acquired in the acquisition step, the information associated with the printing medium input in the inputting step, and the information associated with print quality are related with each other.

17. A computer-readable program comprising the steps of:

acquiring feature information of a printing medium set on a printing apparatus from the printing apparatus;

selecting type information of the printing medium; and registering, in a relational manner, the feature information of the printing medium acquired in the acquisition step and the type information selected in the selecting step, in accordance with a manual registration instruction.

18. A computer-readable program comprising the steps of:

acquiring feature information of a printing medium set on a printing apparatus from the printing apparatus;

displaying information associated with the type of the printing medium, in accordance with the feature information of the printing medium acquired in the acquisition step;

selecting a printing medium type; and making a correction such that the information associated with the printing medium type corresponding to the feature information of the printing medium acquired in the acquisition step is replaced with the printing medium type selected in the selection step, in accordance with a manual correction instruction.

* * * * *